United States Patent [19]

Levinson

[11] Patent Number: 4,685,371

[45] Date of Patent: Aug. 11, 1987

[54] GRAND PIANO ACTION

[76] Inventor: Gary M. Levinson, Zoar Rd., Rowe, Mass. 01367

[21] Appl. No.: 744,134

[22] Filed: Jun. 12, 1985

[51] Int. Cl.[4] ..... G10C 3/18

[52] U.S. Cl. ..... 84/239; 84/223; 84/243

[58] Field of Search ..... 84/223,236, 239, 243, 84/323, 250, 439

[56] References Cited

U.S. PATENT DOCUMENTS 2,172,253 9/1939 Morse et al. ..... 84/239

2,334,444 11/1943 Schulze ..... 84/239

*Primary Examiner*—Benjamin R. Fuller

*Attorney, Agent, or Firm*—Handal & Morofsky

[57] ABSTRACT

Within each action of a grand piano there are certain wood surfaces which rub against other surfaces. These interfaces create friction, which adversely affects the playability of the piano. In order to reduce and overcome this friction, strips of fluorocarbon resin, having an extremely low coefficient of friction, are adhered to those wooden surfaces within the action which come into contact with other surfaces.

24 Claims, 7 Drawing Figures

GRAND PIANO ACTION

TECHNICAL FIELD

The term piano is defined generally as a musical instrument with a keyboard by means of which metal strings are struck by felt-covered hammers to bring forth musical sounds, and includes those instruments which are referred to as upright pianos as well as those which are referred to as grand pianos. A grand piano is distinguished from an upright piano in that the former is a piano in which the strings are stretched horizontally in a harp-shaped body. The instant invention has application to the action of a grand piano rather than to that of an upright piano. The term action generally refers to the inner mechanism of a piano which, in response to the application of pressure on a given key, acts to strike a corresponding string within the piano, as herein more fully described.

BACKGROUND ART

The development of the piano was born out of the need for a keyboard instrument which gave a performer the capability of playing both delicately and softly as well as forcefully and loudly. In order to accomplish this an instrument was needed which had both a responsive mechanism (action) whereby a performer could control the nuances of tone as well as a design which would produce increased volumes, sustainable tones and improved tonal quality.

The grand piano traces its origins back to around 1700 when Bartolomeo Christofori, an Italian harpsichord maker developed an action whereby the strings rather than being plucked were struck by hammers. By 1720 Christifori had improved his action with a satisfactory escapement mechanism which allowed the hammer to leave the "jack" as it approached the string. Therefore, since the hammer was thrown against the string, it was free to bounce back after striking it. This was necessary for the production of a clear unmuffled tone. Christifori's hammer rose toward the back end of the key with the pivot point closer to the front end. Over the next century this design became the basis of the powerful "English Action".

At about the same time that Christifori was developing his action, Schroter, a German organist, developed a hammer action in which the hammer rose toward the front end of the key with the pivot point closer to the back end. This design was the basis of the weaker but more subtle "Viennese Action". These two designs competed for prominence until 1821 when Sebastian Erard of France patented his double escapement repetition action using the hammer orientation of the "English Action". This design combined the light subtle touch of the Viennese Action with the power of the English Action. This action was so reliable and precise in its movements that it was eventually adopted by all of the major piano manufacturers and with some refinements is the grand piano action as we know it today.

Improvements in tonal quality, volume and sustainability proceeded alongside the development of the action. These improvements depended on the development of a hammer which was soft on the surface with a progressively harder interior, a soundboard which would amplify and resonate the tone, and a frame which could withstand the stress of heavier strings under increased tension. By the 1830's it became clear that felt hammers had the ideal density and tone producing characteristics. Likewise by about 1850 it became clear that the ideal soundboard was one made of thin spruce which was slightly tapered.

The development of a satisfactory frame was somewhat more problematic. The earliest pianos were made entirely of wood and could not support the increased tension which the heavier strings required. Thus, by the 1820's iron bars were used to reinforce the frame. These early attempts withstood some increased tension but the sound produced had a metallic quality. In 1843 these problems were significantly ameliorated when Jonas Chickering patented his full iron frame.

However, it was not until 1855 when Steinway produced the overstrung grand frame, in which the bass strings were placed above and oblique to the treble strings, that both increased volume and desired tonal quality were finally realized. This development produced a piano which closely resembles the modern concert grand and over the next century it was refined to become the grand piano as we know it today.

The grand piano has achieved a unique status in the musical arts. A few players have gained international acclaim and recognition as pure artists at this instrument. These artists have in the past and currently tour the world and appear only in the most prominent and prestigious forums. However, they do not transport their own instrument, but select one from many which are located at the site of a concert.

Since each artist is unique in his or her style, and since each piano is unique in its own character, he or she selects that grand piano which fits his or her style, taking into consideration the touch, feel, key weight and other factors described hereinafter in greater detail.

FIG. 1 is a diagram of the relevant moving parts of the grand piano action. Not included for the sake of clarity is the damper action section because it does not relate directly to the invention. Also eliminated from the drawing, for simplicity, are the details of the key structure, the underlever frame and associated components and the damper head and associated structure. All of the major piano manufacturers use this general design with minor variations which in no way affect the applicability of the invention. That which has been identified in FIG. 1 as the front or forward end is that portion of the key 12 which is presented to the artist when he sits at and faces the keyboard of a grand piano. The back or backward end of the key and the action 10 are enclosed within the body of the grand piano. The action at each key is structurally identical to each of the others, except for the fact that, as will be later explained in greater detail, there are weight differences ascending from the treble portions to the bass portions of the keyboard.

Extending across the width of the grand piano are a number of rails, some of which are metal and some of which are wood. Three of these rails support the keys of the grand piano. The rail at the front end of a key is the front rail 14; intermediate the length of the key 12 is the balance rail 16; toward the back of the key is the back rail 18.

There is a rail which supports the hammer flange and the left-off regulating screw. In some pianos, there are two separate rails, one referred to as a regulating rail and the other as a hammer rail, but for purposes of illustration, they have herein been combined into one and are identified as hammer rail 19.

It will be understood that there are eighty-eight keys, all of which are structurally the same, so that, while the following description is in the singular, it applies to each of the plurality of keys.

There is a front rail pin 20 fixed to front rail 14 and extending vertically upward a distance less than the thickness of key 12. A hole is drilled in key 12 to accommodate front rail pine 20. Surrounding the lower portion of front rail pin 20, in the general shape of a washer, is front rail felt 22.

A balance rail pine 24 is fixed to balance rail 16, such pin extending vertically upward through key 12. A hole is drilled through key 12 to accommodate balance rail pin 24. This hole is of a slightly truncated conical shape along the longitudinal axis of key 12 to permit rocking movement of key 12, yet drilled to prevent any sideways movement or wobble of key 12. Surrounding the lower portion of balance rail pin 24, and having a convex upper surface to permit rocking movement of the key, is balance rail felt 26.

Due to the weight of action 10, the back end of key 12 is urged downwardly toward back rail 18. A back rail felt 28 is fixed to the back rail and positioned between back rail 18 and the bottom surface of the back end of key 12 in order that the felt supports the key. Front rail pin 20 and balance rail pin 24 combine to position key 12. The three felts combine to soften the vertical movement of the key and to prevent any unwanted noise which would occur when a key is struck by the pianist.

The balance rail 16 serves as the fulcrum about which piano key 12 pivots as a lever. Screwed into the upper surface of the key, approximately half way between balance rail 16 and back rail 18 is capstan 30, which is a metal screw with a smooth upper face. Capstan 30 contacts support 32 (sometimes referred to as a Whippen) via support cushion 34, which is glued to the underside of support 32. Support 32 rests on capstan 30 by gravity and pivots at support center pin 36 in support flange 38, which is fixed to support rail 39. The repition level flange 40 (sometimes referred to as the support top flange) is fixed to support 32 and extends vertically therefrom. At the upper end of repetition lever flange 40 is located a repetition lever center pin 42, which serves as the fulcrum about which repetition lever 44 (sometimes referred to as a Balancier) pivots.

In support 32, at the end opposite support center pin 36, is located jack center pin 46, which serves as the fulcrum about which jack 48 (sometimes referred to as the fly) pivots. The upper spring 50 urges the front end of repetition lever 44 upwardly, so that the repetition lever regulating screw 52, located at the rear of the repetition lever, is forced down into contact with support 32. The lower spring 54 urges jack 48 backward so that jack regulating screw 56 is forced against spoon 58. The tension on spring 50 is regulated by adjusting screw 51.

While FIG. 1 and this description refer to two separate springs, it will be understood that a single spring may be and is used in certain variations. Such a spring is fixed to the repetition lever flange and is formed so that a lower extension urges the jack in the same direction and fashion as does lower spring 54 while the upper extension urges the repetition lever in the same upward direction and fashion as does upper spring 50.

Repetion lever 44 and jack 48 may move independently of each other. The upper part of jack 48 moves within slot 60 in repetition lever 44 (FIG. 2). The hammer stem 62 pivots about hammer center pin 64 in hammer flange 66. Extending downward in a vertical attitude from hammer flange 66 is drop screw 76 which determines the height that the forward end of repetition lever 44 will travel. Knuckle 68 is fixed to the underside of hammer stem 62 and generally has a smooth buckskin or similar surface 70. Gravity holds knuckle 68 in contact with the top surface of repetition lever 44. The top of repetition lever 44 is set a hair above the top of jack 48. When the pianist pushes down on key 12, the capstan 30 moves upward and lifts support 32. Both repetition lever 44 and jack 48 move with support 32 and lift hammer 72 by pushing up on knuckle 68. When the hammer is about $\frac{1}{8}$ of an inch from the string the upward motion of the forward end 74 of repetition lever 44, having a buckskin covering 75, is stopped by contact with drop screw 76. From this point on, further upward motion of support 32 causes repetition lever 44 to pivot. Also, from this point on, only jack 48 supports knuckle 68 and thus, moves hammer 72 closer to the string (not shown). At about the same time that repetition lever covering 75 contacts drop screw 76, the lower end of jack 48, called the tender 78, contacts the lowermost end of let-off regulating screw 80. From this point on, further upward motion of support 32 causes jack 48 to pivot about jack center pin 46 such that the upper end of jack 48 moves forward under knuckle 68. When hammer 72 is about 1/16 of an inch from the string, the upper end of jack 48 has moved so far forward that it moves out from under and no longer supports knuckle 68. This is referred to as "escapement." Hammer 72 then falls back down so that knuckle 68 contacts the upper surface 88 of repetition lever 44. Just after escapement the under surface of the front of key 12 contacts front rail felt 22. This stops further key movement and therefore further upward movement of support 32.

Thus, during actual playing, the hammer travels the last 1/16 of an inch to the string by virture of its momentum. Depending on the force of the pianist's blow the hammer will come to rest in one of two positions after it bounces back from the string. If a soft blow is struck it will come to rest on the surface of repetition lever 44 in the repetion lever's highest position. If a hard blow is struck it will force down repetition lever 44 until the lower end of hammer 72 wedges itself against backcheck 82. This occurs because the backcheck, a piece of felt with a buckskin covering which is mounted on the back end of the key via stiff wire, moves forward slightly when the forward end of the key is held down.

When the pianist begins to lift his finger from key 12, the back end of the key drops, backcheck 82 releases hammer 72, and support 32 drops. As support 32 drops upper spring 50 causes repetion lever 44 to pivot in the opposite direction from that which it pivoted during the blow. Thus, relative to the downward movement of support 32, forward end 74 of repetition lever 44 moves upward, and hammer 72 moves with it. In terms of absolute position in space, forward end 74 of repetition lever 44 and hammer 72 generally maintain whatever position they ended up in at the end of the blow, as support 32. drops, As this is occurring, jack 48 is also dropping. Because of lower spring 54, as jack 48 begins to drop it pivots in a direction opposite to that which it moved during the blow. Thus, the upper end of jack 48 is urged backward against the forward surface 70 of knuckle 68. At about the same time that repetition lever regulating screw 52 contacts support 32, jack 48 repositions itself back under knuckle 68 and jack regulating screw 56 contacts spoon 58. From this point on, as the front end of key 12 continues to rise, support 32, jack 48 and repetition lever 44 continue to drop and hammer 72 begins to drop back to its original rest position. All motion ceases when the back end of the key contacts back rail felt 28. The advantage of this system is that key 12 may be restruck and a tone resounded as soon as jack 48 is re-positioned under knuckle 68, which is significantly before the pianist has allowed the key to come all the way back up. This permits rapid repetition.

The piano action is weighted such that when it is at rest the front end of the key is in the up position. As the key is depressed the pianist can feel as "resistance" the point at which repetition lever 44 and jack 48 begin to pivot, and as "release" the point of escapement. The "feel" of the resistance and release is called the aftertouch.

The force necessary to overcome friction is a major problem for the pianist and accordingly for the piano manufacturer. In general, when forces are measured, the damper action is not included (this is done by pressing the sustaining pedal or by removing the action from the piano) and the measurements are made between the beginning of key depression up to but not including the aftertouch. These forces are measured by placing weights on the most forward end of the upper surface of the key. The uplift weight is the maximum weight which a depressed key will lift up to its at-rest position. The playing weight is the minimum weight which will depress a key from rest down to aftertouch. Friction increases the force required to depress the key (increased playing weight) and decreases the speed with which the key returns, and therefore the rapidity at which it may be repeated (reflected by a decreased uplift weight). An uplift weight of 20 grams is considered the minimum necessary for rapid repetition. However, the greater the uplift weight the better. A playing weight of about 50 grams is generally considered to be the norm. However, this is a matter of preference to the individual artist and may range from as low as 40 to as high as 60. The limiting factor is the degree of friction, since playing weight equals uplift weight plus weight needed to overcome friction ("frictional weight").

The frictional weight is greater in the bass notes and less in the treble notes because of the relatively greater size and weight of the bass hammers and keys. This greater weight causes greater friction on a given surface. Therefore, the problem of attaining ideal uplift and desired playing weights is greatest in the lowest bass notes.

Piano manufacturers have gone to great lengths in their attempt to reduce the friction which is encountered at all pivot and contact points. The pivot points comprise metal center pins which turn inside either felt or Teflon bushings (Teflon is a registered trademark of the Du Pont Company). A certain degree of tightness is necessary at these points to keep the action parts running true and without wobbling. In addition, Teflon bushings tend to click when they become too loose. The key pivots on the balance rail and moves vertically at the front rail. The front rail pin and the balance rail pin extend into the key and limit the movement thereof. Both of the corresponding holes within the key are lined with felt. At the point of contact between capstan 30 and support 32 a metal surface contacts felt. At all of the above-mentioned friction points there is highly polished metal against felt or its equivalent.

However, there are three points which pose a much more difficult problem because they are wood sliding against felt or buckskin. The wood surfaces are problematic because of their naturally rough surfaces which vary from piece to piece and change with humidity. These three points are the interfaces between repetition lever 44 and knuckle 68, between jack 48 and knuckle 68, and between tender 78 and face 84 of let-off regulating screw 80. The playing weight is not only a reflection of the friction at these interfaces, but also of the friction at all points involving polished metal surfaces against felt surfaces. However, the playing weight does not reflect the marked increase in friction which occurs during aftertouch (the resistance of aftertouch which the pianist feels is caused by a combination of the springs resistance and a marked increase in friction). This increase is due primarily to the upper surface 86 of jack 48 sliding forward under knuckle 68 as jack 48 pivots. Sliding of tender 78 against the felt face 84 of let-off regulating screw plays much less of a role.

There are currently two ways in which piano manufacturers deal with these wood surfaces, namely, the application of graphite or a fast-drying resin bonded flourocarbon dry film lubricant sold under the trademark Emralon (registered by Acheson Colloids Company). When graphite is used, it is usually worked by hand into the wood surfaces above-mentioned. There are several problems with this method:

1. Graphite wears off and periodically needs reapplication.

2. Graphite has a tendency to build up in the felt and buckskin causing them to become hardened. This process increases their friction over a period of time and causes them to click. Additionally, as the piano ages and felts harden, frictional weights will increase. Consequently, the minimum playing weight is further increased.

Emralon is a paint which contains fluorocarbon resins. For optimum performance, this material is sprayed on the wood surfaces at the points previously identified at a thickness which does not exceed 17.8 microns (0.0007 inches). Emralon forms a relatively smooth surface which does not build up in the buckskin or felt. However, Emralon also has several disadvantages:

1. After a few years it has a tendency to wear off leaving a bare wood surface. Because it is sprayed on, it is virtually impossible to re-apply in the field.

2. The minute irregularities of the wood surface are reflected in the Emralon surface.

At the present time in a new concert grand piano which has been regulated to specifications, the frictional weights (weight necessary to overcome friction) will vary from a high of about 31 grams in the lowest bass notes to a low of 22 grams in the highest treble notes. (Weights may vary somewhat between different makes and models). This means that if we add the minimum uplift weight of 20 grams the upper treble will have a minimum playing weight of 42 grams but the lowest bass section will have a minimum playing weight of 51 grams. This minimum playing weight will exist despite all of the above noted attempts to reduce friction. In addition to the normally measured playing weight, the marked increase in friction which occurs during aftertouch is felt as an increase in the resistance to depression of the key. This increase in friction is normally not measured.

Some pianists prefer a touch lighter (i.e. lower playing weight) than that encountered with a minimum playing weight of 51 grams. This can be accomplished by adding extra weights to the front end of the key (there are always some weights necessary to make up for varying wood densities and to give the action the desired balance between uplift and playing weight). Extra weights will have the effect of decreasing the playing weight but they will also decrease the uplift weight by the same amount, thereby slowing the speed of repetition. As a consequence, the ideal way of decreasing the playing weight would be to further decrease the friction. If the friction is decreased, the uplift weight increases by the same amount that the playing weight decreases. This approach permits the greatest flexibility in touch by allowing a broader range of potential playing weights while maintaining the uplift weight above the critical amount of 20 grams.

DISCLOSURE OF INVENTION

The invention is directed to a method of decreasing the friction on the three wood surfaces described above, namely those portions of the upper surfaces of the repetition lever and of the jack which come into contact with the knuckle, and that surface of the tender which comes into contact with the let-off regulating screw. Since the tender surface adds very little friction, and only during aftertouch, it will be understood that this surface may remain untreated without detracting from the invention, or it may be treated in the conventional manner.

BRIEF DESCRIPTION OF DRAWINGS

One way of carrying out the invention is described in detail below with reference to drawings which illustrate only one specific embodiment, in which.

BEST MODE OF CARRYING OUT THE INVENTION

Figure 1:
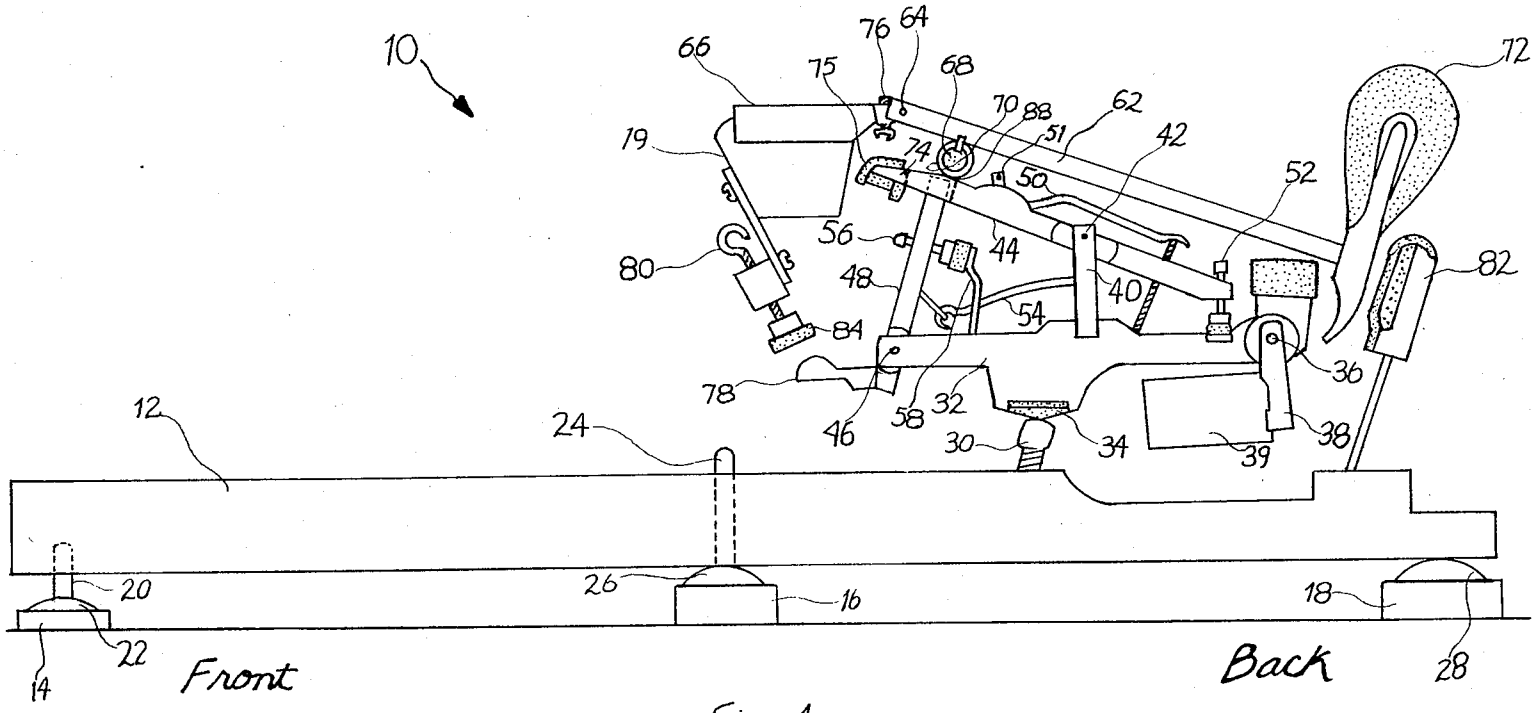
FIG. 1 illustrates the action of a grand piano.
Figure 2:
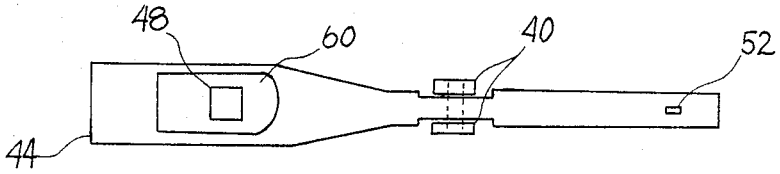
FIG. 2 illustrates the repetition lever within the action of a grand piano, viewed from above.

Fluorocarbon resins, known as Teflon, are available in the form of molded sheet, films and tapes. For the sake of brevity, the term film is used hereafter, with the understanding that any of the three may be used interchangeably. A strip of film 89 is glued to upper surface 88 of repetition lever 44 as well as to upper surface 86 of jack 48. The film is also glued to surface 79 of tender 78 which comes into contact with felt face 84 of let-off regulating screw 80. Ideal thickness of the film is between 0.010 of an inch and 0.020 of an inch. This range assures long term durability while maintaining ease of workmanship. However, thicker film can be used without any loss of effectiveness. Teflon TFE resin is preferred over Teflon FEP resin because of its lower coefficient of friction, but either can be used. Because glue does not bond to Teflon, the Teflon film must be chemically etched on one side. The etched surface can then be glued to the wood at the friction surfaces. That surface of the Teflon film which interfaces with the other surface must not be etched since this would dramatically increase the friction.

Figure 3A:
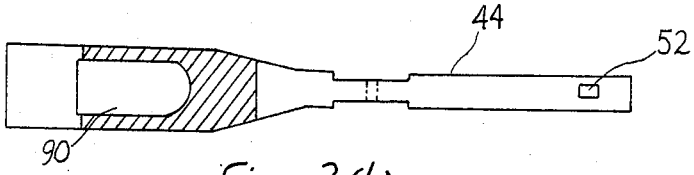
FIGS. 3*a* and 3*b* illustrate two views of the repetition lever of FIG. 2 with a strip of low friction material adhered thereto.
Figure 3B:
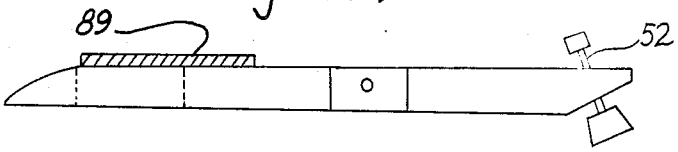

A slot 90 for jack 48 is cut in the film which is glued to upper surface 88 of repetition lever 44. The film will only cover that portion of the repetition lever which contacts knuckle 68 and will not project beyond the upper surface, i.e., it will not stick out to either side or into the slot needed for the jack (FIG. 3*a*).

Figure 4A:
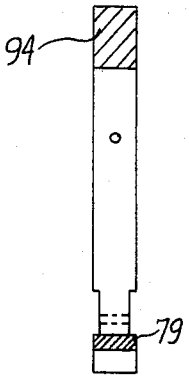
FIGS. 4*a*, 4*b* and 4*c* illustrate three views of the jack and tender from the action of a grand piano with strips of low friction material adhered thereto.
Figure 4B:
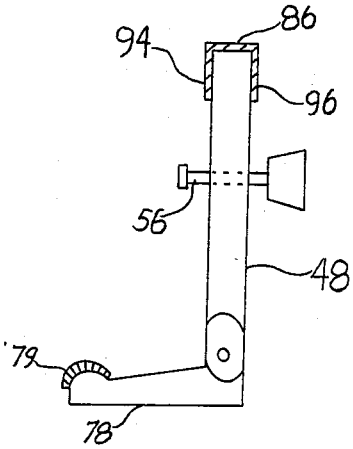
Figure 4C:
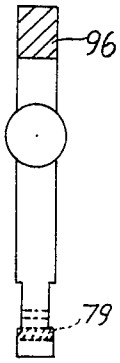

One piece of film is applied to and, in effect, wrapped around upper surface 86, upper front surface 94, and upper rear surface 96 of the jack (FIGS. 4*a*, 4*b* and 4*c*). This will assure that an edge of the tape does not catch on knuckle 68. It is also necessary for the upper rear surface to be covered because this surface contacts the forward surface 70 of knuckle 68 during release when jack 48 attempts to reposition itself under the knuckle.

The Teflon film can be applied with various glues including cyanoacrylate, contact cement, or epoxy, all commercially available.

The advantages of the film made from Teflon resins over previous methods include:

1. Greater longevity and consistency due to the thickness of the film.
2. Ease of replacement in the field.
3. Does not build up on and harden knuckle surface, as is the case with graphite.
4. Greater longevity, consistency and stability, compared to fluoralon or graphite which are constantly changing with use as the Emralon or graphite wear off.
5. Total elimination of the uneven wood surface which changes with changes in humidity. This is because the film made from Teflon resins is a much thicker film which is glued to the wood surface as opposed to Emralon and graphite which are sprayed or rubbed on respectively.
6. Most importantly, the film made from Teflon resins significantly decreases the friction, compared to both Emralon and graphite. This is due to the significantly lower coefficient of friction of 0.04 for Teflon TFE compared to 0.1 for graphite and 0.08 for Emralon. This decrease in friction occurs throughout key depression. It therefore affects both the initial phase of key depression which is reflected in the playing weight as well as the final phase of key depression which is the aftertouch.

Though a decrease in the playing weight is the only easily measurable improvement, there are other improvements which are equally important. These include improvements in both phases of key depression. In the initial phase, the action to which film made from Teflon resins is adhered to has what can be described as a smooth, light, velvety touch. In the final phase, the resistance of the aftertouch is decreased. Because friction is greatest in the bass and least in the treble, the improvement in both phases of key depression is greatest in the bass and least, though still noticeable, in the treble. However, measurement of the playing weight indicates significant improvement in the low bass, gradually decreasing to no improvement in the upper treble. In spite of this, the smooth, light, velvety touch and the decrease in the resistance of aftertouch can be felt throughout the keyboard.

This discrepancy can be explained by an analysis of the frictional characteristics of Teflon, in which an increase in pressure decreases the coefficient of friction. When the playing weight is measured, increasing weights are gently placed on the key until it depresses down to aftertouch. Because of the slow depression, which is consistent from one key to the next, there is negligible acceleration of the hammer and therefore, the weight exerted at the knuckle-jack and knuckle-repetition lever interfaces are almost solely a function of the weight of the hammer plus the hammershank as measured at the knuckle. This weight which is greatest in the low bass and least in the high treble gradually decreases from bass to treble.

TABLE 1

| | FRICTIONAL WEIGHTS BASE←→TREBLE | | | | |
|---|---|---|---|---|---|
| | 1 | 2 | 3 | 4 | 5 |
| [1]Emralon (grams) | 30.5 | 28.9 | 26.8 | 24.7 | 23.6 |
| [2]Teflon (grams) | 26.0 | 24.5 | 24.1 | 24.8 | 24.0 |
| [3]Change in friction (gms) | −4.5 | −4.4 | −2.7 | +.1 | +.4 |
| [4]Predicted change in friction | −4.4 | −4.1 | −3.6 | −3.0 | −2.3 |

Lines 1 and 2 are frictional weights in grams (playing weight minus uplift weight). Line 3 is the change in frictional weight between the Emralon and Teflon action, i.e., between lines 1 and 2.

Line 4 in the predicted change in friction between the Emralon and Teflon actions. (see text)

Table 1 shows the measured data taken from a concert grand piano using Emralon and Teflon TFE film. No other changes were made. The keyboard was broken up into 5 sections using the natural separations created by the cast iron frame. Each section contains between 15 and 20 notes. These are designated in the Table by the five vertical columns. The numbers are average frictional weights, i.e., the weight needed to overcome friction (playing weight minus uplift weight), since either playing weight or uplift weight would only partially reflect the decrease in friction. How the key is finally weighted would determine how much of the decrease in friction ends up decreasing the playing weight or increasing the uplift weight. Lines 1 and 2 indicate frictional weight for the Emralon and Teflon TFE versions, respectively. Line 3 indicates the change in frictional weight from line 1 to 2. Line 4 indicates the predicted change in frictional weight based on a coefficient of friction of 0.04 for Teflon TFE and 0.08 for Emralon. (Each coefficient is multiplied by the actual weight of the hammer and shank as measured at the knuckle to obtain the frictional weights occurring at the knuckle. The difference between the two frictional weights is taken as the predicted change in friction.) Note that the predicted change indicates a steady decrease in improvement from bass to treble. This is because the lighter treble hammers create less friction at the knuckle and therefore any improvement at this interface would have less significance as one moves toward the treble. However, note that in line 3 the actual change in friction is similar to the predicted in sections 1 and 2, is somewhat less than predicted in section 3, and is non-existent in sections 4 and 5. This variation from predicted occurs because the coefficient of friction of Teflon actually increases as the pressure decreases from bass to treble and in section 4 and 5 is similar to that of Emralon.

This variation from predicted is acceptable for two reasons:

1. The frictional weight in the treble section was low to start with and was therefore not a problem. It was the frictional weight of 31 gm (30.5 gm in the prototype in Table 1) in the bass section that limited the potential to decrease the playing weight. Thus the improvement occurred where it was actually needed. Even in the action with Teflon film the bass section continues to have the greatest frictional weight and therefore continues to be the factor limiting playing weight.

2. As noted above the weight at the knuckle determines the coefficient of friction of Teflon. Becuase of the gentle technique used to measure playing, uplift and therefore frictional weight, the weight at the knuckle is essentially that of the weight of the hammer plus the hammershank as measured at that point. However, during actual playing the hammers are accelerated to a great extent and therefore the effective weight at the knuckle is increased. This creates on Teflon a further decrease in the coefficient of friction which can be appreciated during playing.

In summary, the decrease in the frictional weight as measured results in an action in which the bass notes limit the minimum playing weight to a much lesser extent compared to Emralon or graphite. The decrease in frictional weight as well as the further decrease in the coefficient of friction which occurs during playing results in a smooth, light, velvety touch and a decrease in the resistance of aftertouch which is apparent throughout the keyboard. This touch creates a playability which was not previously possible. It gives the pianist a greater control of soft and delicate sublities. Finger movement has a more direct control over hammer movement. Very low volumes can be attained easier and with much less of a chance of a note not sounding. This is because a blow which is too soft to push down the key of a piano using Emralon or graphite will push down the key of a piano to which Teflon tape has been applied.

Thus, the application of Teflon film creates a very significant improvement in the grand piano action. Some of these improvements are measurable. Other improvements, through not readily measurable, are observable and can be felt by the pianist.

Ease of replacement and field service are factors of great significance which bear further explanation. The advantages of using Emralon are greater than when using graphite and it is for this reason that the majority of pianos currently built employ Emralon. A significant disadvantage is that the Emralon must be applied to the friction surfaces during the fabrication of the components of the piano action.

When the Emralon surfaces wear away, and the Emralon must be replaced, the replacement must be accomplished by spraying under tightly controlled conditions and cannot be performed at the situs of the piano. Therefore, either the piano must be returned to the maker, the piano must be disassembled and the entire action returned to the maker, or the specific parts must be replaced. In most instances, either the action is left as it is with barewood surfaces, or the specific parts are replaced.

A major advantage of the instant invention is that the film can be applied by a technician at the location of the piano in a relatively short period of time and at a considerable saving to the owner of the piano. It is not limited to a new piano, or to those now being built, but can be applied to any or all pianos in use, no matter what the age of the piano.

Indeed, the strips of film can be pre-cut and contained in a kit which the technician can carry with him for application at the situs of the piano.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of making a reduced friction action for a grand piano of the type which includes a repetition lever, key means for actuating said repetition lever and a knuckle, said method comprising the step of adhering a strip of film of a low friction polymeric material to that surface of said repetition lever which comes into contact with a surface at the knuckle when a key of said grand piano is struck to lower the friction between said surface and said repetition lever, to increase the responsiveness of the action, and to improve the longevity of the action.

2. The method of claim 1 wherein said strip of low friction material is composed of fluorocarbon resins.

3. The method of claim 1 wherein said strip of low friction material is made from Teflon TFE.

4. The method of claim 1 wherein said strip of low friction material is made from Teflon FEP.

5. A method of making a reduced friction action for a grand piano of the type which includes a jack, key means for actuating said jack and a knuckle, said method comprising adhering a strip of film of a low friction polymeric material to those surfaces of said jack which come into contact with the surface of the knuckle when a key of said grand piano is struck to lower the friction between said knuckle and said jack, to increase the responsiveness of said action and to improve the longevity of said action.

6. The method of claim 5 wherein said strip of low friction material is composed of fluorocarbon resin.

7. The method of claim 5 wherein said strip of low friction material is made from the Teflon TFE.

8. The method of claim 5 wherein said strip of low friction material is made from Teflon FEP.

9. A method as in claim 5 wherein said adhering of said strip is done by adhering said low friction material to the uppermost surface of said jack and extending said material downwardly on two surfaces of said jack a distance slightly in excess of the interface between said jack and the knuckle within said action when the key of said grand piano is struck.

10. The method of claim 9 wherein said strip of low friction material is composed of fluorocarbon resin.

11. The method of claim 9 wherein said strip of low friction material is made from Teflon TFE.

12. The method of claim 9 wherein said strip off low friction material is made from Teflon FEP.

13. A method of making a reduced friction action for a grand piano of the type which includes a jack; a repetition lever, key means for actuating said jack and repetition lever, and a knuckle, said method comprising the steps of adhering strips of film of a low friction polymeric material to those surfaces of the jack and repetition lever which come into contact with the surface of the knuckle when a key of said grand piano is struck to lower the friction between the knuckle, and the jack and repetition lever, to increase the responsiveness of said action and to improve the longevity of said action.

14. The method of claim 13 wherein said strip of low friction material is composed of fluorocarbon resin.

15. The method of claim 13 wherein said strip of low friction material is made from Teflon TFE.

16. The method of claim 13 wherein said strip for low friction material is made from Teflon FEP.

17. In a reduced friction action for a grand piano of the type which includes a jack, a repetition lever, key means for actuating said jack and lever, a hammer, a tender, a let off regulating screw, and a knuckle, said key means comprising a plurality of keys, the improvement comprising a strip of film of a low friction polymeric material disposed on the surface of the jack which comes into contact with a surface on the knuckle when one of said keys of said grand piano is struck to lower the friction between said jack and said knuckle, to increase the responsiveness of said action and to improve the longevity of said action.

18. Apparatus as in claim 17, wherein said low friction material is disposed on a top surface of said jack and is integral with extensions of said low friction material which are disposed on two adjacent sides of said jack and secured thereto by an adhesive.

19. Apparatus as in claim 17, wherein said strip of low friction material comprises fluorocarbon resin.

20. Apparatus as in claim 17, wherein the improvement further comprises a strip of low friction material disposed on a surface of said repetition lever which comes into contact with the surface of the knuckle when a key of said grand piano is struck.

21. Apparatus as in claim 20, wherein said strip of low friction material adhered to said repetition lever is a bifurcated strip having two branches, each of said branches being disposed on respective edge surfaces on the top of said repetition lever, said edge surfaces being disposed on opposite sides of said jack and said strip of low friction material being adhered to said surfaces by an adhesive.

22. Apparatus as in claim 20, wherein the improvement further comprises a strip of low friction material disposed on a surface of said tender which comes into contact with the lowermost surface of said let off regulating screw when one of said keys of said grand piano is struck.

23. Apparatus as in claim 22, wherein said strips of low friction material are composed of fluorocarbon resin.

24. Apparatus as in claim 23, wherein said fluorocarbon resin is Teflon.

* * * * *